US005255997A

United States Patent [19]

Bailey et al.

[11] Patent Number: 5,255,997

[45] Date of Patent: Oct. 26, 1993

[54] METHOD FOR EROSION CONTROL

[75] Inventors: Bert E. Bailey, New Braunfels; W. Al Pollock, Rosenberg; W. Les Thompson, Kemah, all of Tex.

[73] Assignee: Ercon Development Co., Houston, Tex.

[21] Appl. No.: 705,745

[22] Filed: Sep. 3, 1991

[51] Int. Cl.[5] ..... F02B 3/04

[52] U.S. Cl. ..... 405/16; 405/15; 405/52; 405/80

[58] Field of Search ..... 405/15, 16, 21, 22, 405/29-35, 52, 80

[56] References Cited

U.S. PATENT DOCUMENTS

| | | | |
|---|---|---|---|
| 231,957 | 9/1880 | Dyer | 405/21 |
| 449,185 | 3/1891 | Solomon . | |
| 611,588 | 9/1898 | Brooks . | |
| 687,382 | 11/1901 | Neale . | |
| 812,045 | 2/1906 | Kellner . | |
| 875,480 | 12/1907 | Westenhaver | 405/21 |
| 877,201 | 1/1908 | Kellner . | |
| 880,390 | 2/1908 | McGregor | 405/21 |
| 1,060,357 | 4/1913 | Nies . | |
| 1,849,323 | 3/1932 | Cleveland et al. . | |
| 2,000,312 | 5/1935 | Wood . | |
| 2,162,499 | 6/1939 | Borhek . | |
| 2,341,515 | 2/1944 | Rehfeld . | |
| 2,662,378 | 12/1953 | Schmitt et al. . | |
| 3,299,640 | 1/1967 | Nielsen . | |
| 3,333,420 | 8/1967 | Henson . | |
| 3,564,853 | 2/1971 | Csiszar . | |
| 3,590,585 | 7/1971 | DeWinter . | |
| 3,672,638 | 6/1972 | Krebs | 256/12.5 |
| 4,135,843 | 1/1979 | Umemoto et al. | 405/18 |
| 4,148,466 | 4/1979 | Wilson | 256/47 |
| 4,221,500 | 9/1980 | Garrett | 405/24 |
| 4,279,535 | 7/1981 | Gagliardi et al. | 405/15 |
| 4,374,629 | 2/1983 | Garrett | 405/24 |
| 4,388,019 | 6/1983 | Kjihara | 405/25 |
| 4,439,059 | 3/1984 | Kikuzawa et al. | 405/25 |
| 4,710,056 | 12/1987 | Parker | 405/15 |
| 4,710,057 | 12/1987 | Laier | 405/30 |
| 4,711,597 | 12/1987 | Odgaard et al. | 405/15 X |
| 4,738,563 | 4/1988 | Clark | 405/52 |

FOREIGN PATENT DOCUMENTS

| | | |
|---|---|---|
| 113487 | 6/1929 | Austria . |
| 53-98291 | 8/1978 | Japan . |
| 638663 | 12/1978 | U.S.S.R. . |
| 1016414 | 7/1983 | U.S.S.R. . |
| 1030466 | 7/1983 | U.S.S.R. . |
| 1071977 | 6/1967 | United Kingdom . |

*Primary Examiner*—Dennis L. Taylor
*Attorney, Agent, or Firm*—Alton W. Payne

[57] ABSTRACT

A method and apparatus for ascertaining and implementing the permeability effective for preventing and repairing scour or erosion in a control zone associated with a river or shoreline having a bank and a bed associated with a moving fluid. The method provides for preventing and repairing scour or erosion in a control zone associated with a river or shoreline having a bank and a bed associated with a moving fluid. Associated therewith, a variably permeable jetty system (Palisade TM system) is provided for preventing and repairing scour or erosion in a control zone associated with a river or shoreline having a bank and a bed associated with a moving fluid.

38 Claims, 11 Drawing Sheets

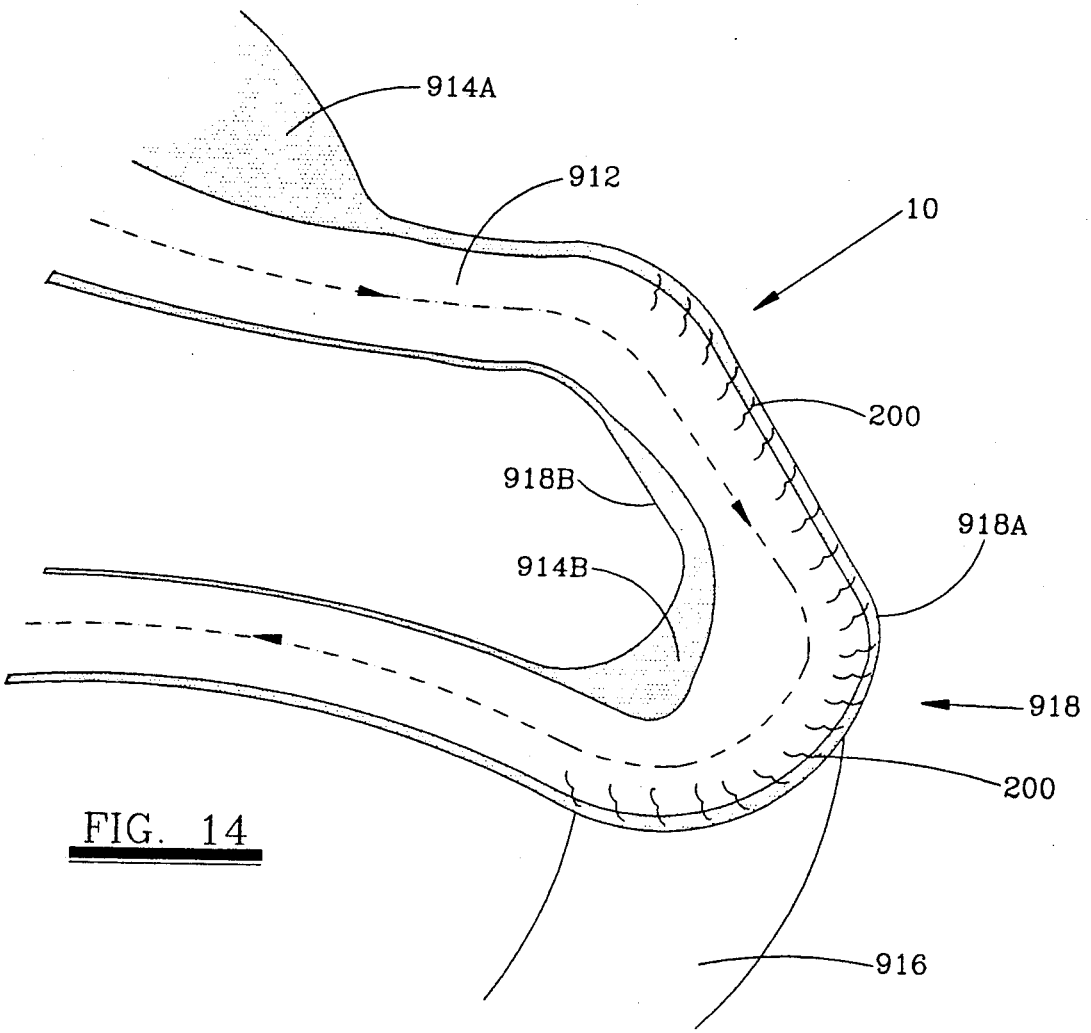
FIG. 14
FIG. 15
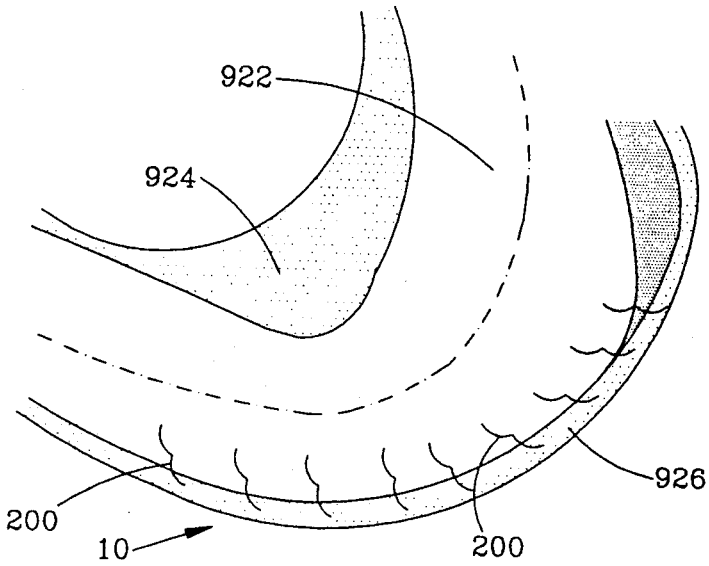

METHOD FOR EROSION CONTROL

FIELD OF THE INVENTION

The present invention relates generally to fluid transport phenomena. Specifically, the present invention relates to a method for ascertaining and implementing the permeability effective for preventing and repairing scour or erosion in a control zone associated with a river or shoreline having a bank and a bed associated with a moving fluid, and an associated variably permeable jetty system (Palisade TM system) is provided for preventing scour or erosion.

BACKGROUND OF THE INVENTION

The phenomenon of scour, i.e., to clear or remove by a current of fluid, is a well known problem associated with rivers and shorelines in association with bodies of moving water. Scouring and erosion mechanisms are present and associated with any river bed or shoreline which is associated with a moving fluid. Scour is especially important when trying to maintain or stabilize the geologic structure of the river or shoreline.

The scour of sediment from the river bed and river bank beneath a body of moving water is a difficult problem. Scour is enhanced with an increase in the velocity of the fluid and the moveability of the material comprising the river bed, river bank or shoreline. Scour is the progressive removal of the material and the transport of this material from one location in the river bed to another location.

It is well known to retard the scouring or erosion process by using sandbags to refill the holes caused by the removed material or for filling in the river bed or river bank which has been altered by the scouring process. Other techniques have also been employed. Of interest is U.S. Pat. No. 3,333,420 to K. W. Henson for a Method and System for Controlling the Course of a River. The Henson patent uses a plurality of fence-like structures with vertical slats for dissipating river flow. Also U.S. Pat. No. 4,279,532 to Gagliardi, et al. for Material and System for Minimizing Erosion provides a silt fence which can be used to minimize the transport of silt by the flow of water. Still further, U.S. Pat. No. 2,341,515 to G. W. Rehfeld for Jetty Structure for Controlling River and Surface Water provides a jetty structure having vertically planar and vertically horizontal woven wire or rods for preventing water from scouring the bottom surface under the horizontally planar rods or wire. Still further, U.S. Pat. No. 449,185 to D. H. Solomon for A device for Preventing Banks from Caving provides a plurality of radially oriented screens for mounting along a bank and for orienting to radiate from a specific point in the river.

All of the presently known or used devices and methods for preventing, reducing or repairing scour and erosion in the vicinity of a river bed or shoreline address the effects of the scouring process. The devices and methods, some of which are discussed above, are merely engineering techniques that have been developed to deal with a common and universal problem as applied to a specific situation. None of the discussed devices or methods seeks to address the cause of the scouring or erosion.

Numerous and varied factors can enhance the scouring or erosion phenomenon. Of significant importance is the consistency of the material in which the structure is embedded. A river bed consisting of non-cohesive material is extremely susceptible to erosion and scouring forces. Thus, a river bed beneath a body of moving water that consists substantially of silty material, sand or gravel is highly susceptible to the scouring process. The scouring process is enhanced by the presence of such non-cohesive material, since scouring requires the disengagement, suspension and movement of river bed and bank sediments.

Another critical parameter associated with the scouring process is the velocity of the fluid. There exists a critical current velocity associated with, but not exclusive of, the geometry of the river or shoreline and the material or sediment to be transported. Thus, a critical current velocity required to initiate scour can be expressed as a function of, at least, the following parameters: the geometric shape of the river, the velocity of the fluid, the size of the sediment material to be transported, the density of the sediment material to be transported and the shape of the sediment material to be transported.

Scour and erosion can adversely effect the geometric shape and geological structure of rivers and shorelines. For example, due to extremely heavy rains in one particular season, excessive river flow can cause the geologic, and heretofore natural, flow pattern of the river to be deviated. As the non-cohesive sediment making up the river bed is transported, the geologic structure of the river is changed. As water moves down the river bed, the flow velocities change drastically with the geometric shape of the river bed. For example, as the water approaches a river bend, the higher velocities are measured at the outer, radial portions of the bend. Typically, centrifugal forces as well as inertial forces cause the increased radial velocities.

There is thus a need for a variably permeable jetty system which can be ideally designed for river bed or shoreline having a bank, a bed, and associated with a body of moving water, which, provides for the control of scour and erosion in appropriate areas.

It is, therefore, a feature of the present invention to provide a unique variably permeable jetty system for implementation with a river or shoreline having a bank, a bed, and associated with a body of moving water for strategically controlling the different flow velocities associated with the body of moving water.

It is a more particular feature of the present invention to provide a variably permeable jetty system to manipulate and control the transport mechanisms associated with the movement of material in the vicinity of a river bend or shoreline.

Another feature of the present invention is to provide a variably permeable jetty system for controlling the specific flows that cause scour and erosion.

Yet another feature of the present invention is to prevent the impingement, on the sediment material comprising a river bed and bank, of the higher velocity flow associated with a river bend.

Yet still another feature of the present invention is to provide a variably permeable jetty system that reduces the size of the separation of the fluid flow associated with the jetty system for reducing the down stream wake and turbulence associated with the jetty system.

A further feature of the present invention is to provide a variably permeable jetty system for reducing the magnitude of the resistance associated with the variably permeable jetty system while engaging the enhanced scour forces associated with a river bend or shoreline.

Still further a feature of the present invention is to provide a variably permeable jetty system for controlling the scour of, the transport of and the deposition of sediment material forming a river bed or shoreline.

Additional features and advantages of the invention will be set forth in part in the description which follows, and in part will become apparent from the description, or may be learned by practice of the invention. The features and advantages of the invention may be realized by means of the combinations and steps particularly pointed out in the appended claims.

SUMMARY OF THE INVENTION

In accordance with the present invention, a unique method for ascertaining the permeability effective for preventing and repairing scour or erosion in a control zone associated with a river or shoreline having a bank and a bed associated with a moving fluid is provided, the method comprising the steps of determining bank characteristics upstream of, within and downstream of the control zone, determining bed characteristics upstream of, within and downstream of the control zone, determining fluid characteristics upstream of, within and downstream of the control zone, and employing the characteristics for ascertaining a permeability effective for preventing and repairing scour or erosion in a control zone associated with the river or shoreline. More particularly, the method of the present invention comprises the steps of determining at least one spatial property of the bank, determining at least one physical parameter of the bank, determining at least one spatial property of the bed, determining at least one physical parameter of the bed, determining at least one spatial property of the fluid in the bed, determining at least one physical parameter of the fluid in the bed, and employing the spatial property determinations and the physical parameter determinations for ascertaining a permeability effective for preventing and repairing scour or erosion in a control zone associated with the river or shoreline.

In accordance with another embodiment of the present invention, a method for preventing and repairing scour or erosion in a control zone associated with a river or shoreline having a bank and a bed associated with a moving fluid, the method comprising the steps of determining at least one spatial property of the bank, determining at least one physical parameter of the bank, determining at least one spatial property of the bed, determining at least one physical parameter of the bed, determining at least one spatial property of the fluid in the bed, determining at least one physical parameter of the fluid in the bed, employing the spatial property determinations and the physical parameter determinations for eliciting one or more permeability effective for preventing and repairing scour or erosion in control zone associated with the river or shoreline, and permeating the moving fluid with the elicited permeability prior to the moving fluid contacting the bank in the control zone.

In accordance with yet another embodiment of the present invention, a system for preventing and repairing scour or erosion in a control zone associated with a river or shoreline having a bank and a bed associated with a moving fluid, said apparatus comprising a spatial property measuring means for determining one or more spatial properties of the river or shoreline, a physical parameter measuring means for determining one or more physical parameters of the river or shoreline, and a permeator means for controlling the moving fluid prior to contacting the bank in the control zone such that said permeator means employs the spatial property determinations and the physical parameter determinations for eliciting one or more permeability effective for preventing and repairing scour or erosion in the control zone associated with the river or shoreline.

Preferably, the spatial property measuring means measures one or more spatial parameters of the river or shoreline including the height of the bank contiguous with the control zone, the relative height of the bank opposite the control zone, any change in the height of the bank, the gradient of the bed (i.e., the average drop of the bed), the reach of the bed of the river upstream of the control zone, the present crossover point of impact of the fluid with respect to the control zone, the possible movement of the crossover point of impact of the fluid with respect to the control zone, the direction of the fluid in the bed and other parameters affecting the spatial properties of the river or shoreline.

Further, the physical parameter measuring means measures one or more physical parameters of the river or shoreline including the density of the bank, the rigidity of the bank, the porosity of the bank, the density of the bed, the turbidity of the fluid associated with the bed, the porosity of the bed, the fluidity of the bed, the sediment load of the fluid in the bed, the drop out velocities of the fluid in the bed, the speed of the fluid in the bed, the turbidity of the fluid in the bed, the temperature of the fluid in the bed, the density of the fluid in the bed, the salinity of the fluid in the bed, the surface tension of the fluid in the bed, the pressure of the fluid in the bed and other parameters affecting the physical properties of the river or shoreline.

BRIEF DESCRIPTION OF THE DRAWINGS

The accompanying drawings, which are incorporated into and constitute a part of the specification, illustrate a preferred embodiment of the invention and, together with the general description of the invention given above and the detailed description of the preferred embodiment given below, serve to explain the principles of the invention.

FIG. 14 is a plan view of the variably permeable jetty system as used in an acute river bend situation;

FIG. 15 is a plan view of the variably permeable jetty system of the present invention as used to stabilize an eroded river bank.

The above general description and the following detailed description are merely illustrative of the generic invention, and additional modes, advantages and particulars of this invention will be readily suggested to those skilled in the art by the following detailed description.

DETAILED DESCRIPTION OF THE PREFERRED EMBODIMENT

Reference will now be made in detail to the presently preferred embodiment of the invention as illustrated in the accompanying drawings.

Figure 1:
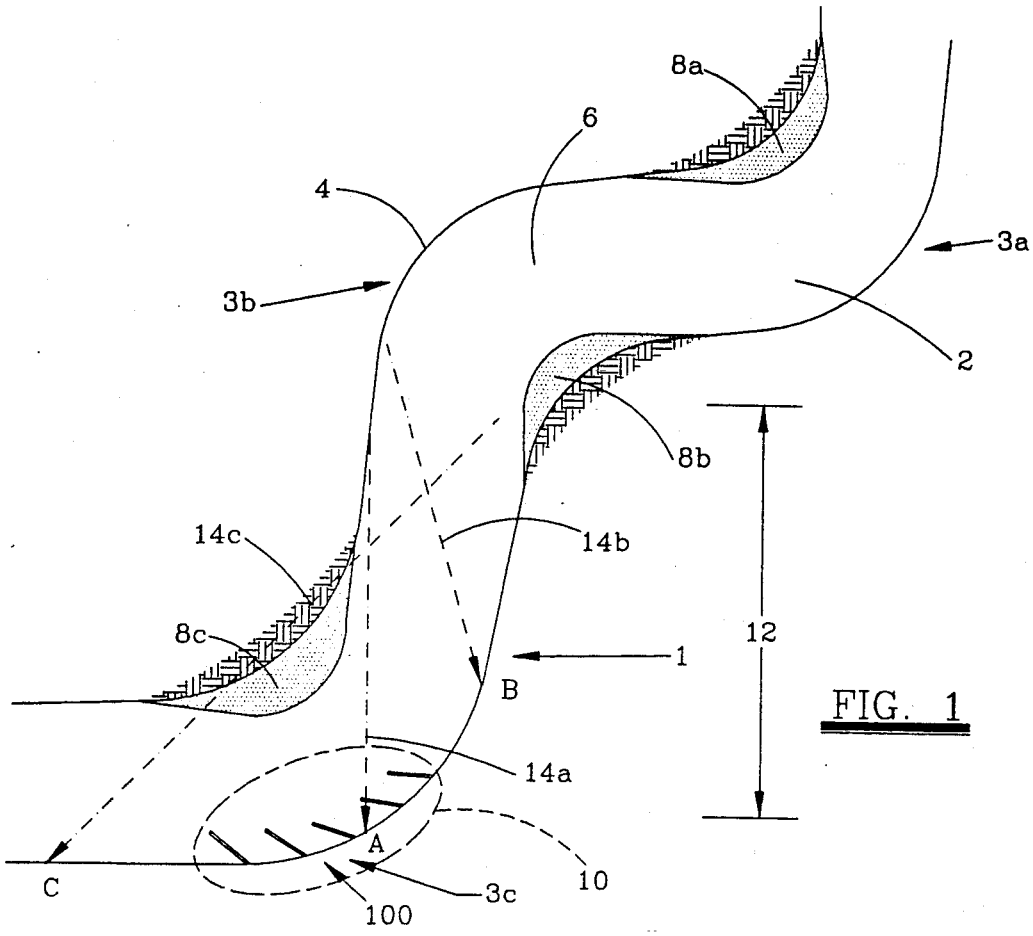
FIG. 1 is a plan view illustration of a river for discussion of the present invention.

FIG. 1 is a topographical illustration of a river 1 having three bends 3*a*, 3*b*, 3*c*. The river 1 is also illustrated having three sand bars 8*a*, 8*b*, 8*c*. The river 1 has a bed 6 and a bank 4. The bed 6 and a bank 4 contain the moving fluid 2.

In FIG. 1, an example of an area of primary concern is illustrated as the control zone 10. The control zone 10 has a reach 12 of the river 1 upstream thereof. The location of the point of impact A associated with the crossover point 14*a* for the control zone 10 is critical. Knowing an accurate location of the impact point A is important. It can be appreciated that the crossover point of the fluid 1 can change depending on the meandering of the river. For example, the crossover point could be altered to have a crossover line 14*b* with an impact point B. Alternately, the crossover 14*c* could swing upstream to yield an impact point C. In practicing the present invention, it is important to have the impact point A maintained within the control zone 10.

Figure 2:
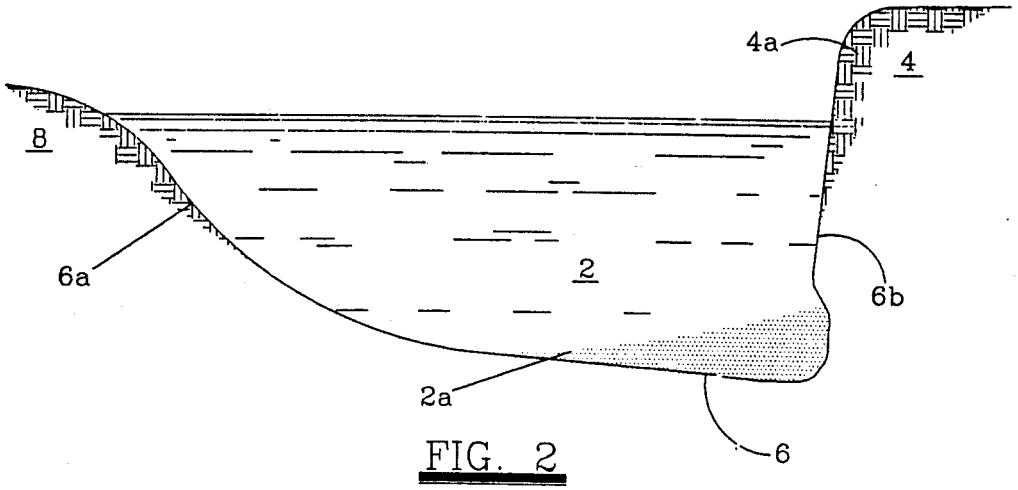
FIG. 2 is a cross section along the section line 2—2 in FIG. 1 illustrating a portion of a control zone associated with practicing the present invention.

FIG. 2 illustrates a cross-section of the river 1 at the control zone 10. The bank 4 is illustrated with inconsistencies 4*a*. Also, bank 4 has a corresponding bank which is the sandbar or alternate bank 8. Between the bank 4 and the sandbar 8 is the moving fluid 2. The moving fluid 2 is contained by the bank 4, the sandbar 8 and the bed 6. The extremities of the bed 6 have a steep bed gradient 6*b* and a slight bed gradient 6*a*. If any of the material comprising the bank 4, the sandbar 8 or the bed 6 goes into suspension, turbidity 2*a* is present in the fluid 2.

It is important in practicing the present invention to acquire information about the spatial parameters associated with the specific site on the river which the prevention or repair of the scour or erosion within the control zone 10 is sought. It can be appreciated by those skilled in the art that each river situation is different and distinct. However, to fully appreciate the breadth of the present inventive concept, the spatial parameters of typical concern include, but should not be limited to, the height of the bank contiguous with the control zone 10, the relative height of the bank 4, 8 opposite the control zone 10, any change in the height of the bank 4, the gradient 6*a*, 6*b* of the bed 6, the reach 12 of the river 1 upstream of the control zone 10, the present crossover line 14 associated with the point of impact A of the moving fluid 2 with respect to the control zone 10, any possible movement of the crossover point of impact, e.g., points B and C in FIG. 1, the direction of the moving fluid 2 and the bed 6 as well as other parameters affecting the spatial parameters of the river 1.

Also of import in practicing the present invention are the physical parameters associated with the river 1. Just as with spatial parameters, numerous physical parameters are present, and such physical parameters are obviously site specific. For illustrative purposes, without limitation, physical parameters of interest are the density of the bank 4, 8, the rigidity of the bank 4, 8, the porosity of the bank 4, 8, the density of the bed 6, the turbidity of the moving fluid 2 associated with the bed 6, the porosity of the bed 6, the fluidity of the bed 6, the sediment load of the fluid 2 and the bed 4, the drop-out velocities of the fluid 2 in the bed 4, the speed of the fluid 2 in the bed 6, the turbidity of the fluid 2 in the bed 6, the temperature of the fluid 2 in the bed 6, the density of the fluid 2 in the bed 6, the salinity of the fluid 2 in the bed 6, the surface tension of the fluid 2 in the bed 6, the pressure of the fluid 2 in the bed 6 as well as any other physical parameters affecting the property of the river.

The present invention provides for a variably permeable jetty system for "training" the course of a river. The system provides variably permeable diffusers which have a permeable relationship which is a function of the flow of the water. The matrix structure utilized in the present invention has a permeability (i.e., the density of the vertical lattice members and the horizontal lattice members) which is approximately proportional to the "natural" flow (without the present invention) of the water in the river. Thus, in one embodiment of the present invention, the density of the matrix structure is increased as the natural flow of the water increases. Stated in the alternative, the porosity of the matrix structure of the present invention is inversely proportional to the natural flow of the water in the river. Also, the present invention utilizes a structure which can be readily assembled and disassembled, which are durable and last for extremely long periods of time, and which can be readily replaced by disassembly and reassembly.

The permeability of river training systems practicing the present invention influences river velocities to move the thalweg of the river outboard of the river training system. The present invention attempts to minimize turbulence or eddy currents within and around the apparatus of the invention. Typically, the highest velocity is outboard of the system. The velocity through the system is substantially uniform at any fixed distance from the river bank. The velocity decreases from the outer edge to the river bank with the lowest velocity at the river bank.

The present invention achieves less turbulence by displacing the highest velocity channel (thalweg) smoothly and gradually. Since the thalweg of the river will always be just outboard of a structure, a shear plane will contain the highest velocity. Displacement of the thalweg of the river from the bank creates a quite zone of low velocity between the thalweg and the bank.

The present invention provides one or more palisade-type panels to incorporate variable permeability to provide smooth reduction of flow velocity along the length of the panel or structure. In addition, the permeability can be varied in a vertical dimension to place the highest permeability at, for example, the upper outboard corner of the structure where there is the least risk of excessive turbulence and scour causing system failure.

The present invention can be adapted for use in many ways. A uniform fixed permeability of palisade-type panels can be provided by varying each net type by location according to design criteria. Alternately, uniform fixed permeability of palisade-type panels can be used for a portion of the system with the outboard panels constructed to be linearly variable both in a horizontal and vertical plane. In yet another embodiment, all panels are continuously variable in a horizontal and vertical plane.

The permeabilities, the number and type of nets or panels, the structure's length of penetration into the river. The length of the system and final placement are adjusted by site specific variables such as, for example: (1) velocity of river flow at nominal and high (flood) levels, (2) length of system, (3) length of structures, (4) river bed sediment and potential for transport and scour down, (5) spacing of structures, (6) upstream crossover point and potential for movement, (7) angle of repose of underwater river bed at nominal flow, (8) amount of thatch transported by river, (9) width of river and opposite side bank relief area, (10) upstream river configuration, and (11) width of river relative to structure length.

Figure 3:
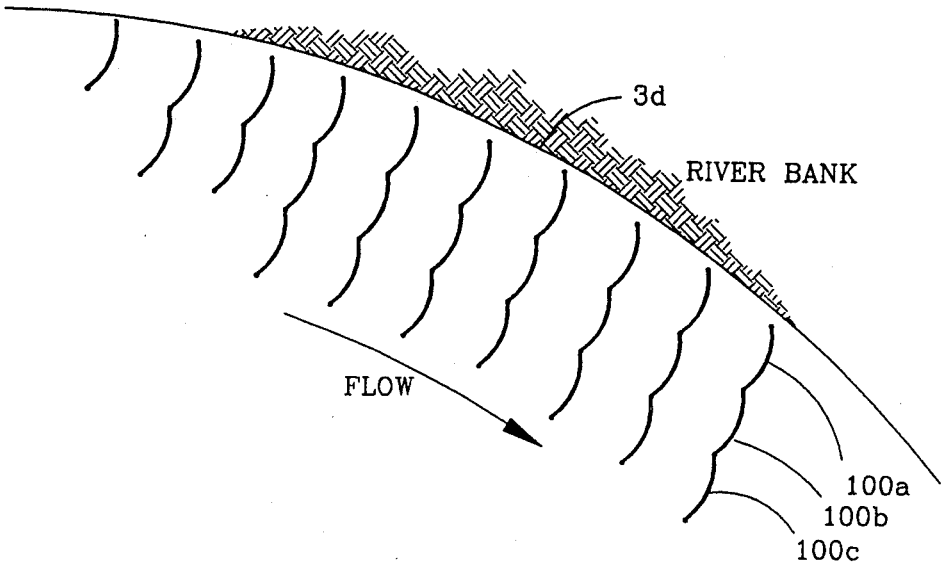
FIG. 3 illustrates an example of a river for practicing the present invention having a gentle river bend, a hard bottom, course sediment in suspension, low bank height and speed and gradual toe of slope.
Figure 4:
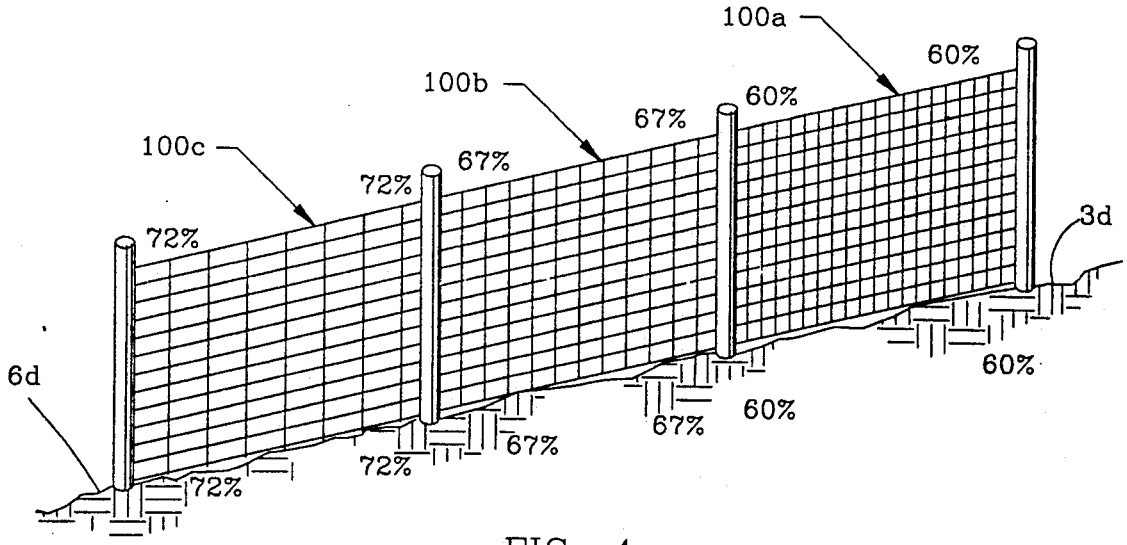
FIG. 4 illustrates a structure for use with a system in association with the river illustrated in FIG. 3.

To better understand the intricacies of the present invention, three general examples will be provided. FIG. 3 illustrates a river bank 3*d*. The bank 3*d* has a gentle river bend. The river bed is comprised of hard clay or gravel. The general proportion of the river is a wide river versus the length of the erosion control structure. Course sediment is in suspension in the example illustrated in FIG. 3. The bank 3*d* is low in height and the velocity of the moving fluid 2 is low at nominal flow. The toe of slope gradient associated with the bank 3*d* and the bed 6*d* is gradual. A plurality of erosion control structures are affixed along the control zone 10 having permeabilities designed specifically for the particular site. FIG. 4 illustrates the erosion control structures illustrated in FIG. 3. FIG. 4 illustrates structures 100*a*, 100*b*, 100*c*. The structures have constant permeabilities with the permeability of each structure increasing from the bank 3*d* toward the bed 6*d*.

Figure 5:
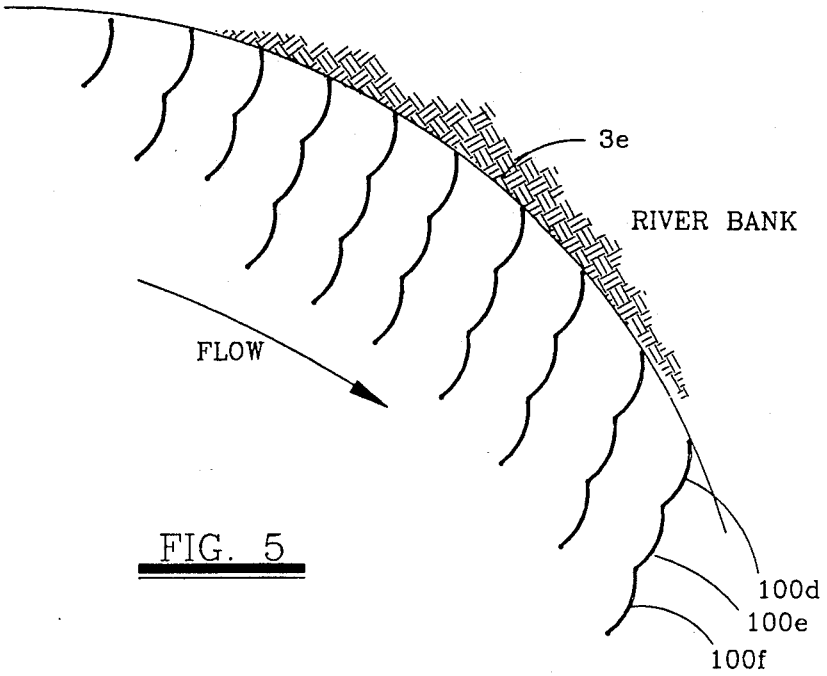
FIG. 5 illustrates an example of a river for practicing the present invention having a moderate river bend, a sandy bottom, average sediment in suspension, medium bank height and speed and moderate toe of slope.

FIG. 5 illustrates another example with a moderate river bend. The river bed 6 is sandy. The river 1 is moderately wide versus the structure length. There is an average amount of sediment in suspension in the moving fluid 2. The bank height is moderate or medium and the velocity of the moving fluid 2 is medium at nominal flow. The toe of slope gradient of the bed 6 is moderate.

Figure 6:
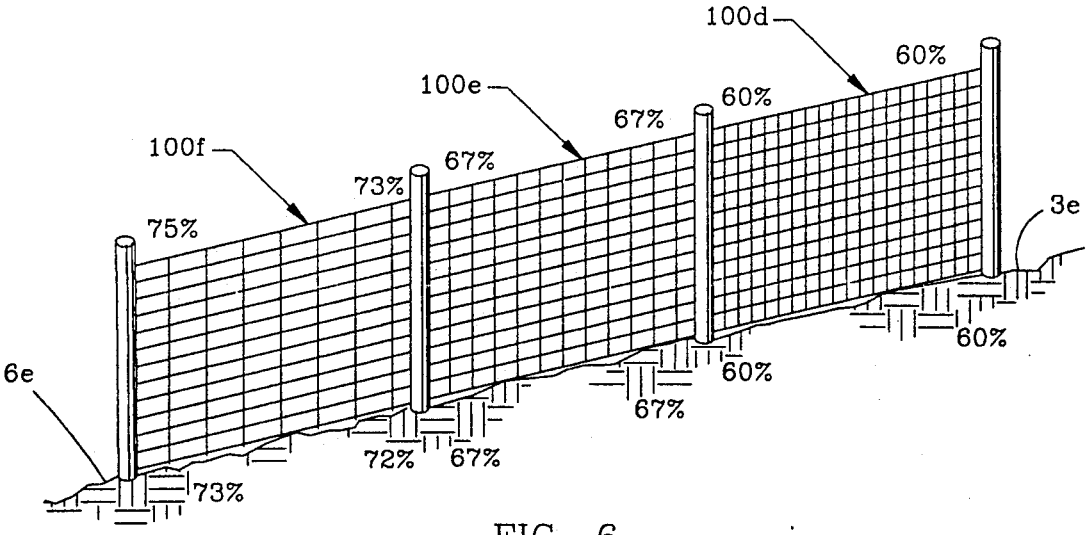
FIG. 6 illustrates a structure for use with a system in association with the river illustrated in FIG. 5.

FIG. 6 illustrates the preferred control structures for the parameters illustrated and discussed in FIG. 5. The structures 100*d*, 100*e*, 100*f* increase in permeability from the bank 3*e* toward the center of the bed 6*e*. However, differing from the structures in FIG. 4, the present structures 100*d* and 100*e* have constant permeabilities. The structure 100*f* remote most from the bank 3*e* has a varying permeability. The permeability varies diagonally from the bottom bank most at 72% permeable to the upper extreme location 75%. The alternate diagonal corners are maintained at 73% permeable.

Figure 7:
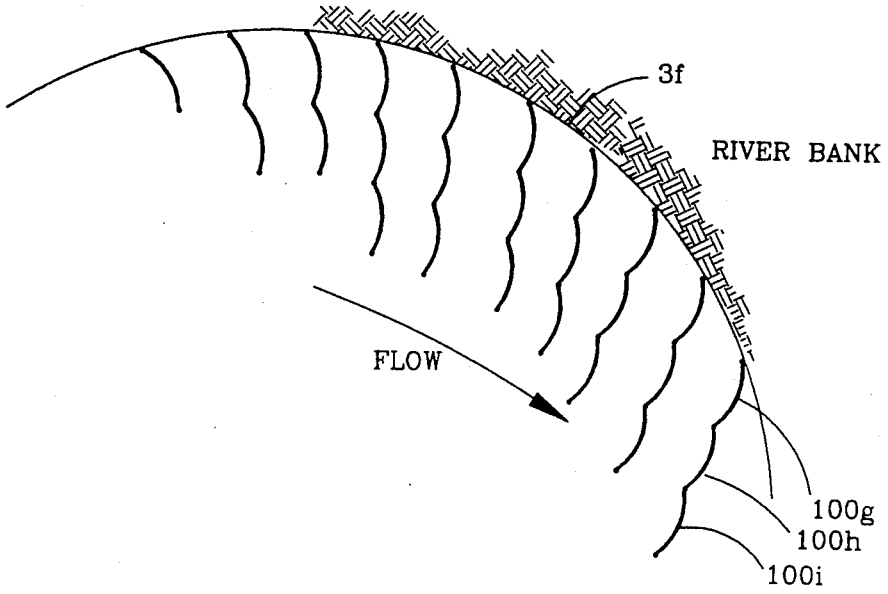
FIG. 7 illustrates an example of a river for practicing the present invention having an extreme river bend, a soft bottom, fine sediment in suspension, high bank height and high flow velocity and steep toe of slope.

FIG. 7 is yet another example of an application of the present invention. The river 1 bank 3*f* has an extreme bend. The river bed 6 is soft and silty. The river is narrow versus the structure length. The sediment in suspension is quite fine. The bank 3*f* is high and the velocity of the moving fluid 2 is high at normal flow. The toe of slope gradient is quite steep.

Figure 8:
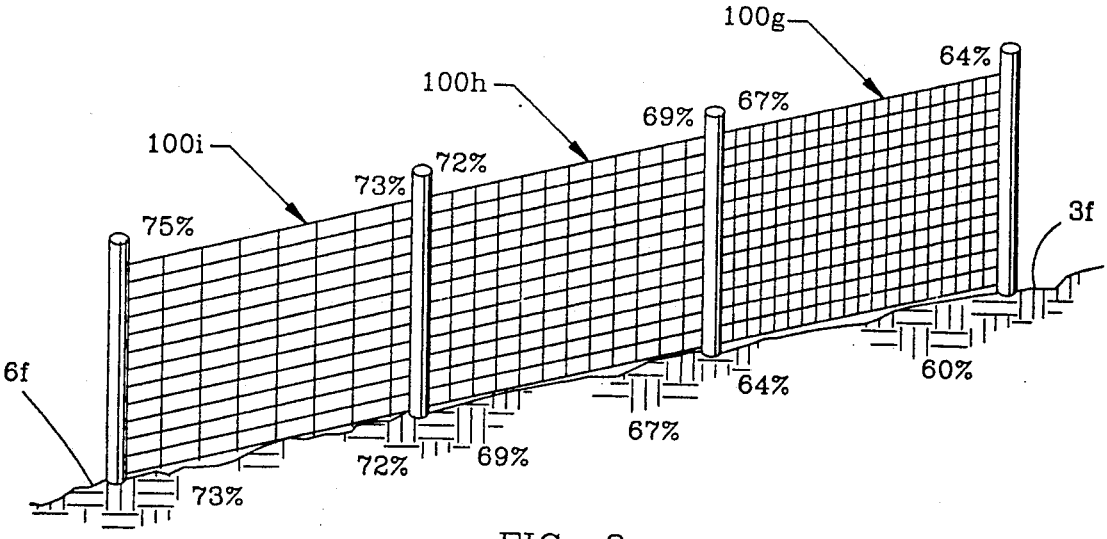
FIG. 8 illustrates a structure for use with a system in association with the river illustrated in FIG. 3.

The structure illustrated in FIG. 8 corresponds to the physical embodiment described in FIG. 7. The structure illustrated in FIG. 8 has multiple structure 100*g*, 100*h*, 100*i*. The permeability of each structure is variable. The first structure 100*g* varies in permeability from bank side to river side of 64% at the top to 67%, and 60% at the bottom to 64%. Similarly, the structure 100*h* varies from 60% to 72% on the top, and 67% to 69% on the bottom. Likewise, the structure 100*i* varies from 73% on the top to 75%, and 72% on the bottom to 73%.

Figure 9:
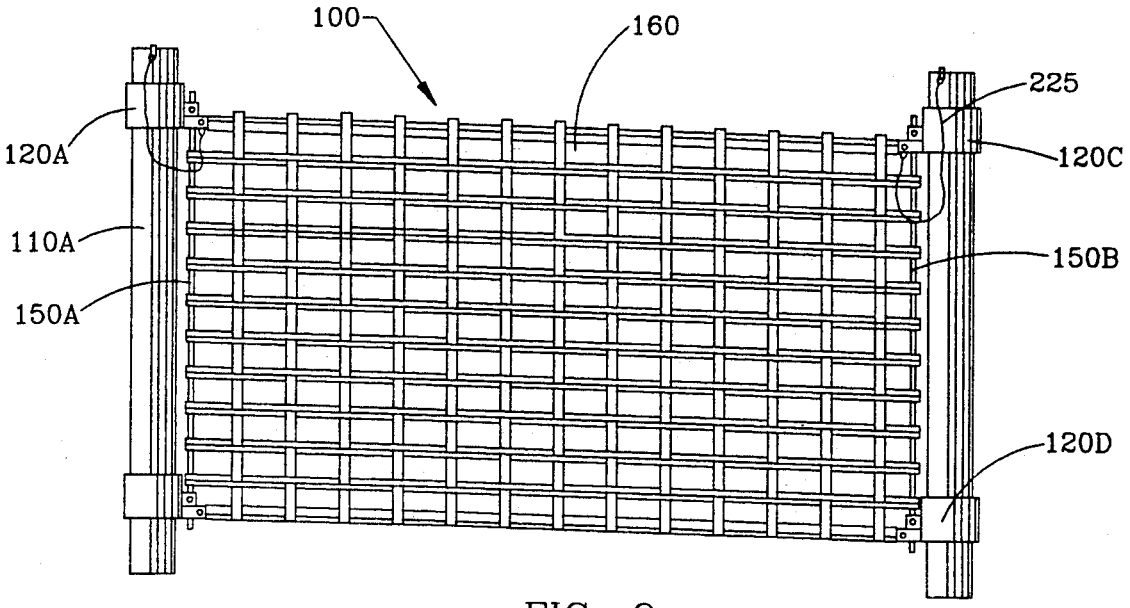
FIG. 9 is a front elevation of a preferred embodiment of a single diffuser associated with the variably permeable jetty system of the present invention.

In FIG. 9, there is shown a front elevation view of a single diffuser 100 of the variably permeable jetty system 10 (see FIGS. 14 and 15) of the present invention. The single diffuser 100 comprises the stanchions 110*a*, *b*, the sleeves 120*a*, *b*, *c*, *d*, the vertical supports 150*a*, *b*, the matrix structure 160 and the restraining cable 225. The matrix structure 160 is moveably secured between the stanchions 110*a* and 110*b* using the sleeves 120*a*, *b*, *c*, *d* and the vertical supports 150*a*, *b*. The lower vertical supports 120*b* and 120*d* are fixedly secured a distance from the upper sleeves 120*a* and 120*c* using the vertical supports 150*a* and 150*b*, respectively. As the lower portion of the single diffuser 100 is exposed to scour, the matrix structure 160 is allowed to sink with the scour and the sleeves 120 in conjunction with the vertical supports 150 move in unison to fill the scour location.

Preferably, the matrix structure 160 is oriented to provide a variably permeable surface to engage the flow of the body of water. Although not illustrated in FIG. 9, the permeability of the matrix structure 160 can be increased or decreased in any specific location or locations, e.g., the permeability can be increased from bottom to top, or alternatively, the permeability can be increased from left to right, or vice versa.

Preferably, the matrix structure 160 is made of an ultraviolet resistant material. Since the structure will be exposed to sun light during variations in tidal rivers and for other reasons, the matrix structure would have a tendency to deteriorate due to ultraviolet radiation. The matrix structure material is preferably treated to resist deterioration due to ultraviolet radiation. For example, the matrix material could be a close weave polyester webbing material or nylon straps interwoven into a high-strength net. The straps may be 2 inches wide and have a minimum tensile strength of approximately 5,000 pounds. The average elongation of straps may be approximately 7 percent when loaded to about 2,500 pounds.

The permeability associated with practicing the present invention does not decrease as outbound scour occurs. As the net panel 100 (see FIG. 9) angles due to scour, the voids created by the vertical lattice members 62 and the horizontal lattice members 166 become parallelograms rather than a rectangles. Thus, the apparatus and method of the present invention maintains its effectiveness and permeability as unexpected scour may be present in the control zone. Prior known systems decrease permeability as scour down occurs. Prior known systems create a localized higher velocity of jet streams at the stream wise edge of the device to create even higher velocities, turbulence and increased scour. Such higher velocities, turbulence and increased scours are due to changes in system permeability and have lead to system failures. The present invention maintains its effectiveness and permeability. The present invention provides that irregular contours of the bed are engaged. Further, irregular contours of the river bed which occur as the system "settles in" are also accommodated.

The cable reinforcements 170 accommodate extreme loading. Also, the cables 150A, 150B (see FIG. 9) act to accommodate extreme loading. The cables 150A, B, 170 extend the capability of the system to handle higher debris loading and higher flow velocities without damage or failure.

The cable restraints 225 limit the depth a panel 100 can scour down. As panels 100 scour down, particular where river beds readily go into solution. Prior systems lose effectiveness if the panels bury themselves sufficiently to allow increased flow velocity to over top the structure. The cable restraints 225 can be adjusted for each panel 100 to establish specific scour down limits.

Figure 10:
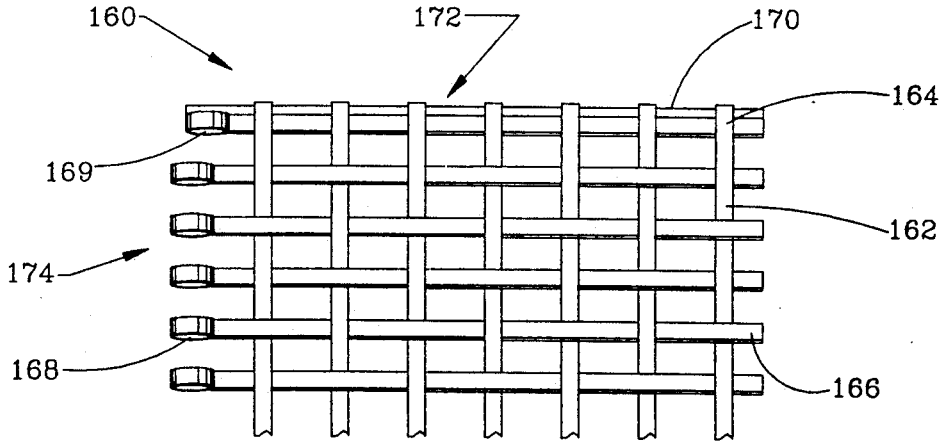
FIG. 10 is a fragmentary front elevation of a portion of the matrix structure associated with the variably permeable jetty system illustrated in FIG. 1.

FIG. 10 illustrates a fragmentary front elevation of a portion of the matrix structure 160. The matrix structure 160 comprises the vertical lattice members 162, the horizontal lattice members 166 and the support member 170. Preferably, the vertical lattice members 162 and the horizontal lattice members 166 form rectangles. Thus, the vertical lattice member 162 sections are shorter and the horizontal lattice members 166 sections are longer. The rectangles formed by the vertical lattice members 162 and the horizontal lattice members 166 provide that the entrapment of debris is less likely in the present invention than in prior known devices.

Rivers transport a large amount of debris and agricultural thatch. This debris and thatch can reduce the permeability of most systems. When the permeability is reduced, excessive turbulence is created at the edges of the system. Excessive turbulence enhances scour and provides for a worse situation then existed prior to the implementation of such a system. Since the up stream end of such systems is impacted the most with such debris and thatch, the accelerated flow is typically diverted along the bank behind the system and could result in system failure. The specific height versus width aspect ratio and size of the openings in the panels used in the present invention are selected to prevent thatch build up.

The vertical lattice members 162 have at their extremities horizontal channels 164. Similarly, the horizontal lattice members 166 have at their extremities the vertical channels 168. Also, the end most horizontal lattice member 166 is slightly shorter for creating an end vertical channel 169 which is in registry with only its corresponding end most channel. The other vertical channels 168 are in registry. Also, the horizontal channels 166 are in registry. The horizontal channels 166 except the support member 170 there through. The vertical channels 168 are adapted for accepting the stanchion 110.

Figure 11:
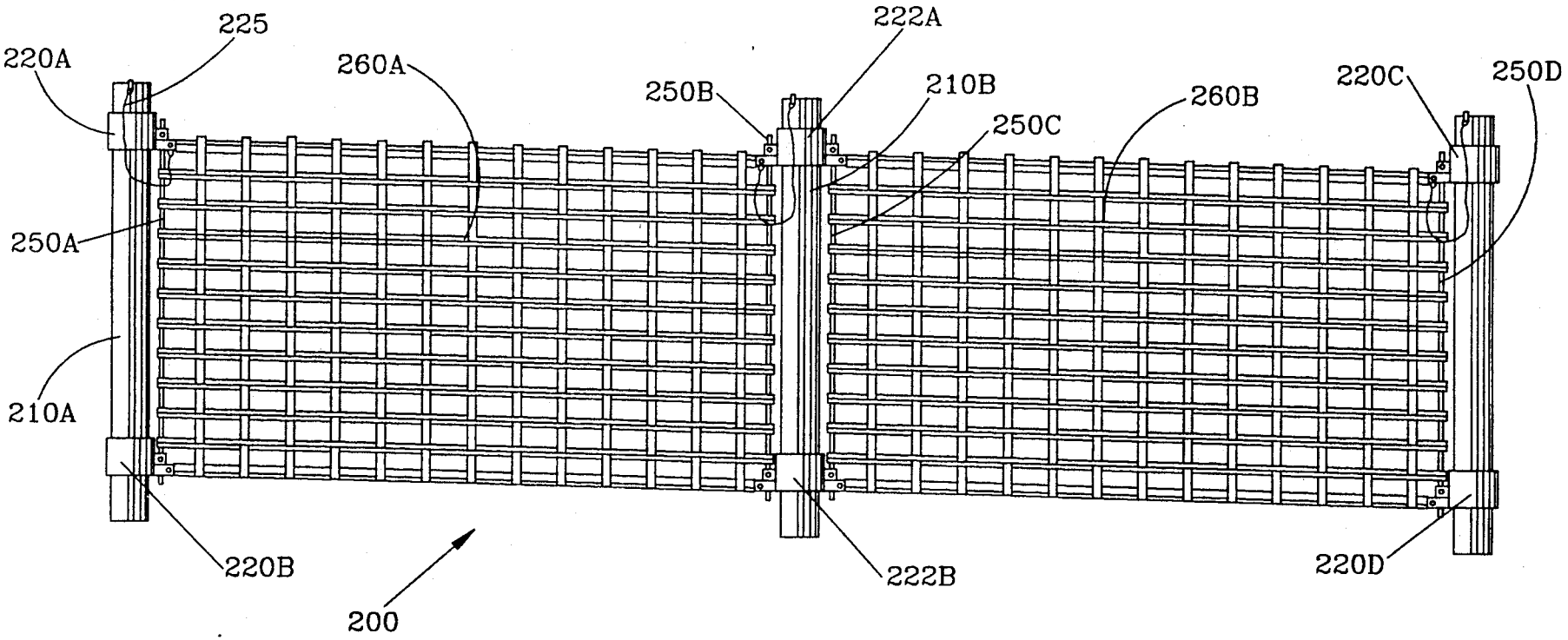
FIG. 11 illustrates another preferred embodiment of the present invention utilizing a double diffuser approach to the variably permeable jetty system of the present invention.

FIG. 11 illustrates a double diffuser 200 which is an alternate embodiment of a portion of the variably permeable jetty system 10. The double diffuser 200 comprises the stanchions 210*a, b, c*, the sleeves 220*a, b, c, d*, the double sleeves 222*a, b*, the vertical supports 250*a, b, c, d* and the matrix structures 260*a, b*. The sleeves 220*a, b* and 220*c, d* are moveably associated with the stanchions 210*a* and 210*c*, respectively, the sleeves 220*a* and 220*c* are fixedly displaced using the vertical supports 250*a* and 250*d*, respectively. The stanchion 210*b* is fixedly secured in the river bed at a location between the stanchions 210*a* and 210*c*. The double sleeves 222*a* and 222*b* are maintained at a distal relationship using the vertical supports 250*b* and 250*c*. The matrix structure 260*a* is moveable secured between the stanchions 210*a* and 210*b* by aligning the vertical channels 168 of the horizontal lattice members 166 for accepting the vertical supports 250*a* and 250*b*. The upper parameter of the matrix structure 260*a* is maintained in its spaced relationship with the lower parameter of the matrix structure 260*a* by aid of the support member 170. The support member 170 removably secured between the sleeve 220*a* and the sleeve 222*a*. The matrix structure 260*b* is similarly secured to the respective parts as previously described for matrix structure 260*a*.

Figure 12:
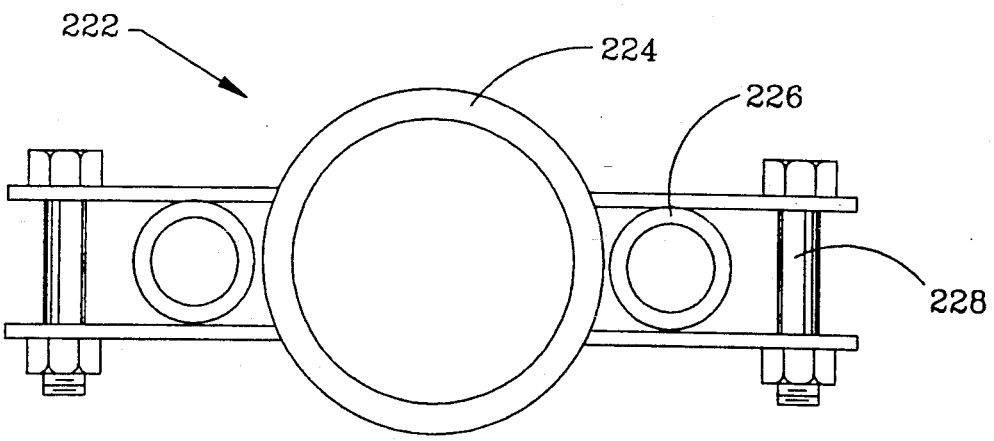
FIG. 12 is a plan view of a sleeve used in conjunction with the variably permeable jetty system illustrated in FIGS. 1 and 3 for moveably securing the matrix structure to the stanchions.

FIG. 12 is a cross-section plan view of the sleeve 222. The sleeve 222 comprises the stanchion acceptor 224, the support acceptor 226 and the pin 228. For brevity, the double sleeve 222 is described. However, the sleeve 220 is similarly constructed with only one support acceptor 226 and one pin 228.

Figure 13:
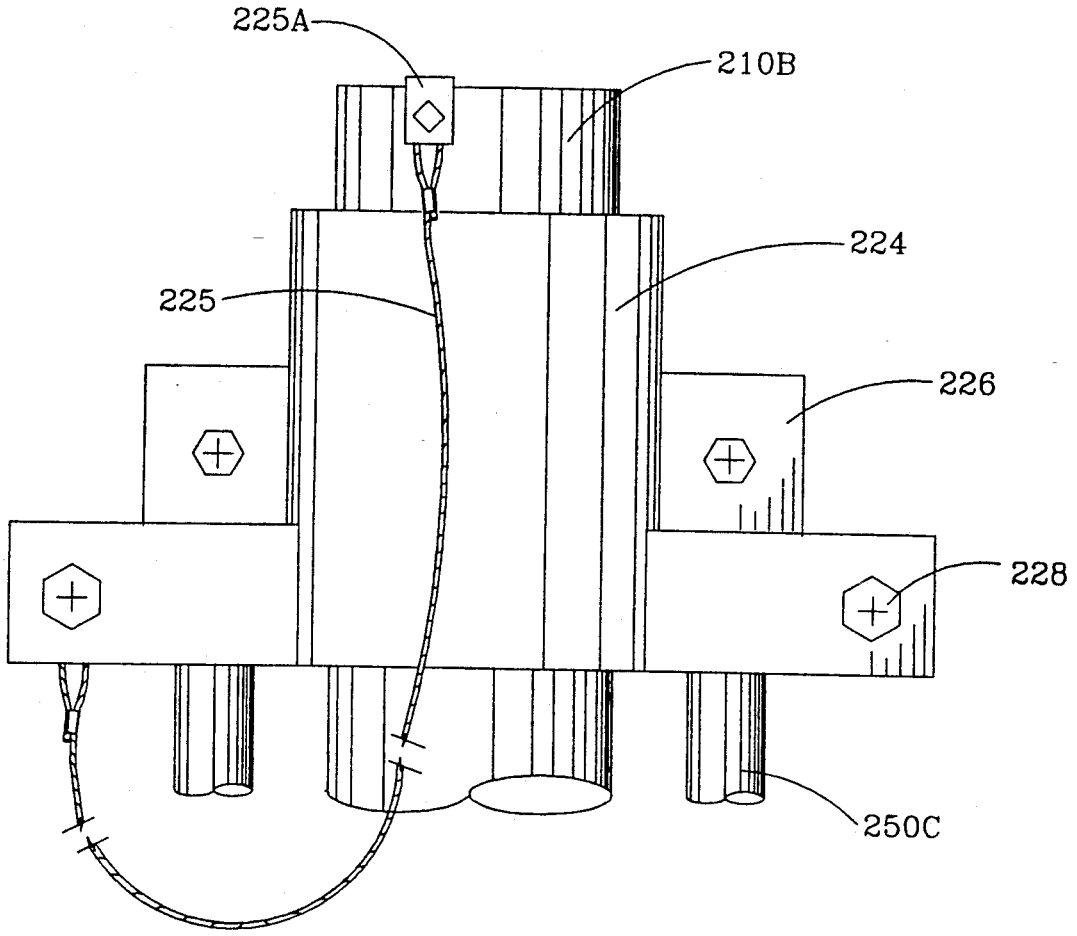
FIG. 13 is a side elevation view of the sleeve in FIG. 4 used in conjunction with the variably permeable jetty system of the present invention.

FIG. 13 is a perspective side view of a double sleeve 222. The double sleeve 222 is engaged with the stanchion 210*b* and the vertical supports 250*b* and 250*c*. The sleeve 222 is illustrated in FIG. 13 such that the stanchion acceptor 224 and the support acceptor 226 provide that the stanchion 210*b* and the vertical supports 250*b* and 250*c* are aligned to provide for parallel central axis. The pin 228 is used for removably engaging the end vertical channel 169 of the upper most and lower most horizontal lattice members 166. Thus, the pins 228 removably engage the end vertical channels 169 for securing the horizontal parameter 172 (see FIG. 10) of the matrix structure 260. The restraining cable 225 is attached to the stanchion 210*b* by a clip 225A. The restraining cable 225 is a critical element of the present invention at sites that the bed becomes fluid. The restraining cable 225 can be set at a length for securing the vertical position of the panels for maximum effect. Without the restraining cable 225 the panels could and would migrate into the bed when the bed becomes fluid, resulting in losing the entire system.

FIG. 14 is an illustration of the use of the variably permeable jetty system 10 of the present invention with an acute river bend. The river 912 is illustrated having a sand bar 914*a* prior to the river bend 918. Since the higher velocities impinge against the outer edge 918*a* of the river bend 918, erosion and scour is prolific in this area. Similarly, the slower portions of the river are adjacent the inner edge 918*b* of the river bend 918. Since the slower velocities of the river are adjacent the inner edge 918*b*, a sand bar 914*b* develops along the inner edge 918*b* of the river bend 918. Also, at extremely high flooding times, the bank of the river bend 918 is over flowed due to the extremely high velocity and an over run area 916 is experienced. It can be appreciated that unless the velocities adjacent the outer edge 918*a* of the river bend 918 are controlled, the geologic structure of the river may be varied to deviate and consistently run along the over run area 916 rather than along the river's original path.

FIG. 14 illustrates the use of the double diffusers 200 in forming a variably permeable jetty system 10 for controlling the scour and erosion adjacent the outer edge 918*a* of the river bend 918. In the present situation, the over all planar structure of the double diffusers 200 is aligned to be slightly downstream of orthogonal to the flow of water from the river 912 as is impinges on its planar surface. Thus, as one approaches the river bend 918 in passing the sand bar 914*a* the double diffusers 200 are almost parallel to the out edge 918*a* of the river bend 918. As the curvature of the river increases, the angular relationship of the double diffusers 200 is enhanced. The double diffusers 200 are maintained at a position that is slightly downstream of orthogonal to the flow of water. In maintaining the orthogonal position of the double diffusers 200 to the water flow, the double diffusers 200 are required to be at obtuse angles with respect to the river bend.

FIG. 15 is a perspective plan view of the variably permeable jetty system 10 as used in an obtuse river bend. The variably permeable jetty system 10 utilizes double diffusers 200 which are offset from the eroded bank 926. Thus, as the river 922 passes through the variably permeable jetty system 10, the transport of sediment can be controlled for causing the sediment to deposit in the area adjacent to the eroded bank 926. Thus, the use of the variably permeable jetty system 10, as illustrated in FIG. 15, provides for a deposition system for building up and reinforcing the eroded bank 926.

Figure 16:
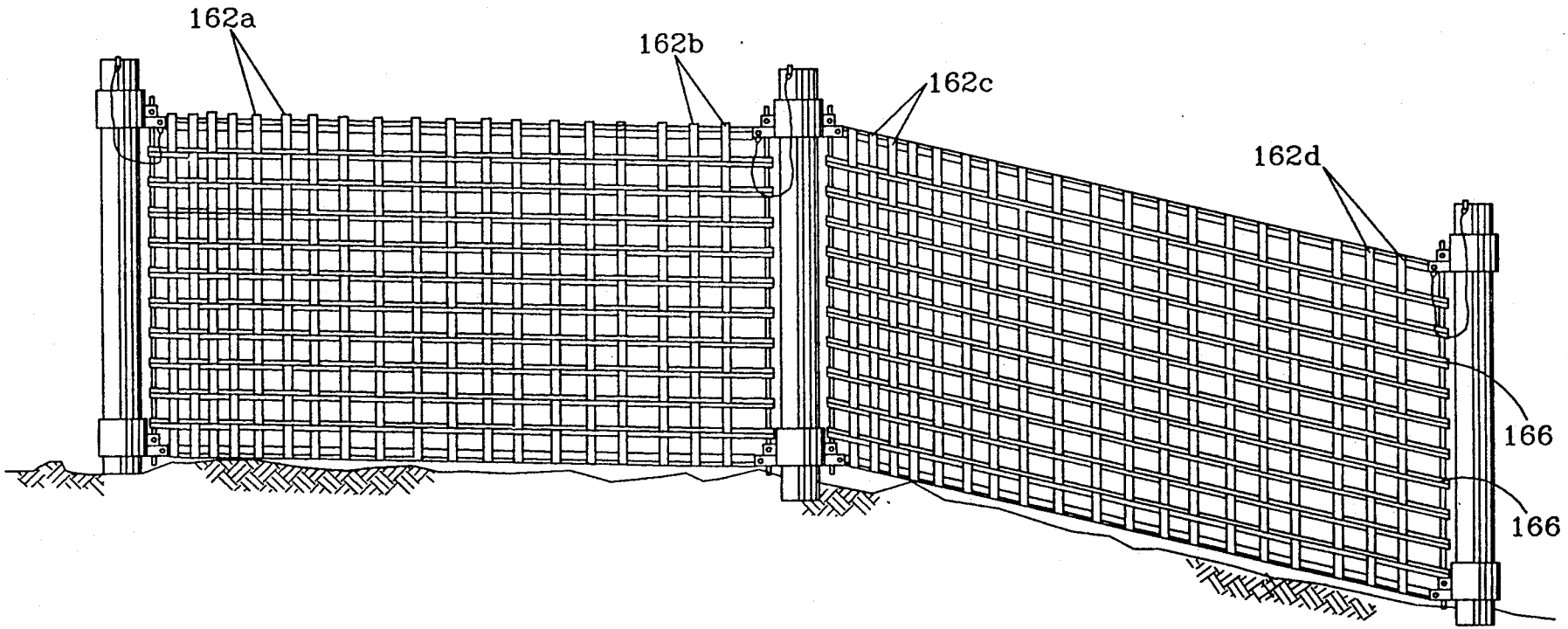
FIG. 16 illustrates a front elevation view of a double diffuser as used with the present invention.

In FIG. 16, there is shown a front elevation view of a double diffuser 200. The embodiment of the present invention illustrated in FIG. 16 shows a variation of permeability. Specifically, the vertical lattice members 162 are gradually displaced further apart throughout the longitudinal direction of the double diffuser 200. The horizontal lattice members 166 remain constantly placed. Thus, the permeability varies linearly with the length of the double diffuser from vertical lattice member 162*a* through vertical lattice member 162*d*.

Figure 17:
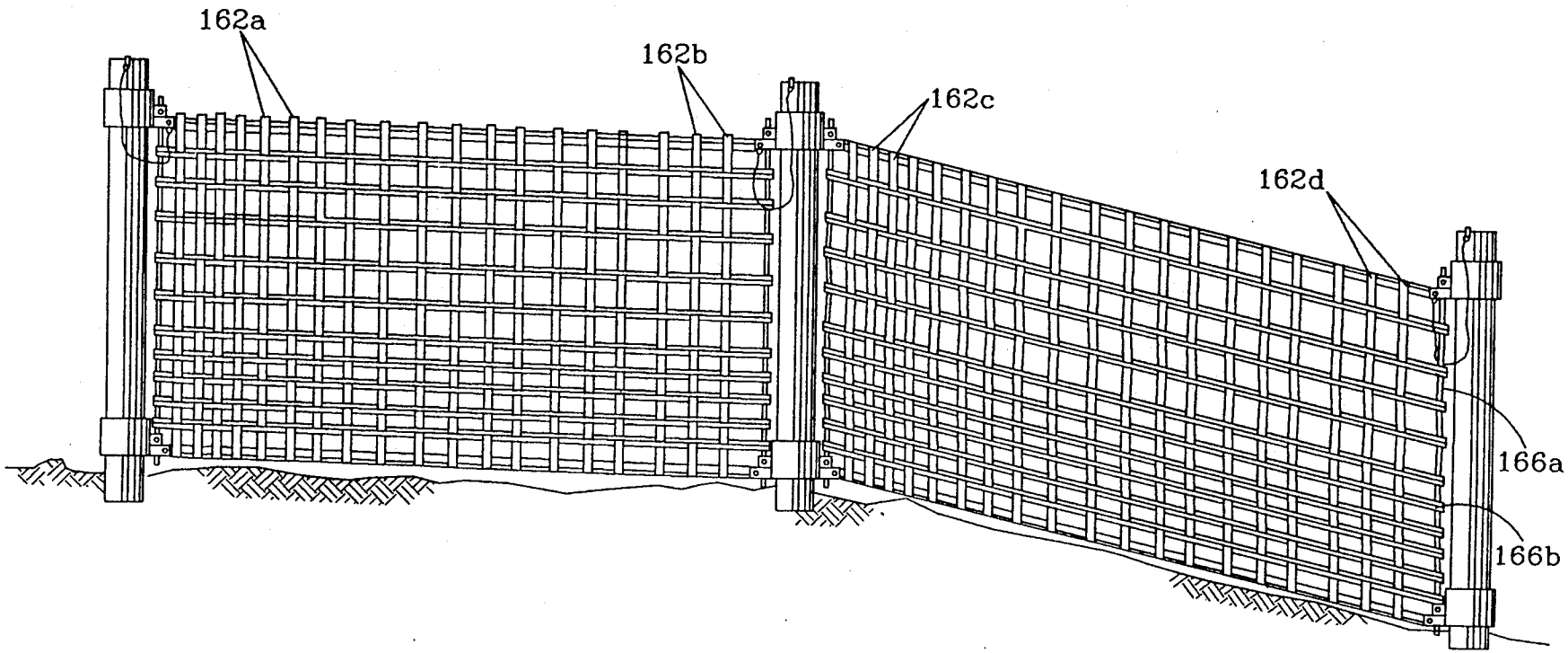
FIG. 17 illustrates a double diffuser with the permeability varying both laterally and longitudinally.

FIG. 17 illustrates a double diffuser 200 whereby the permeability of the system varies both laterally and longitudinally. The vertical lattice members 162 are gradually displaced further apart, i.e., lattice member 162*a* through lattice member 162*d*. Similarly, the horizontal lattice members are gradually displaced further from their adjacent members as they procress from horizontal lattice member 166*b* to horizontal lattice member 166*a*. The ability to readily dismantle the matrix structure 160 and replace it with a new structure having a different permeability greatly enhances the utilization of the present invention. Thus, the training of a river can be finely tuned utilizing the same construction site by merely changing the matrix structures 160.

The present invention is quite useful in bidirectional capabilities. The present system is unique in that it has bidirectional loading capabilities. The present system has equal strenth in both directions, e.g., boards won't tear off the back side as in prior known devices. Since river training systems are often subject to reverse flows created by tidal action, vessel traffic and eddy currents, the apparatus and methods of the present invention are designed to work equally well regardless of the flow direction of the fluid.

Figure 18:
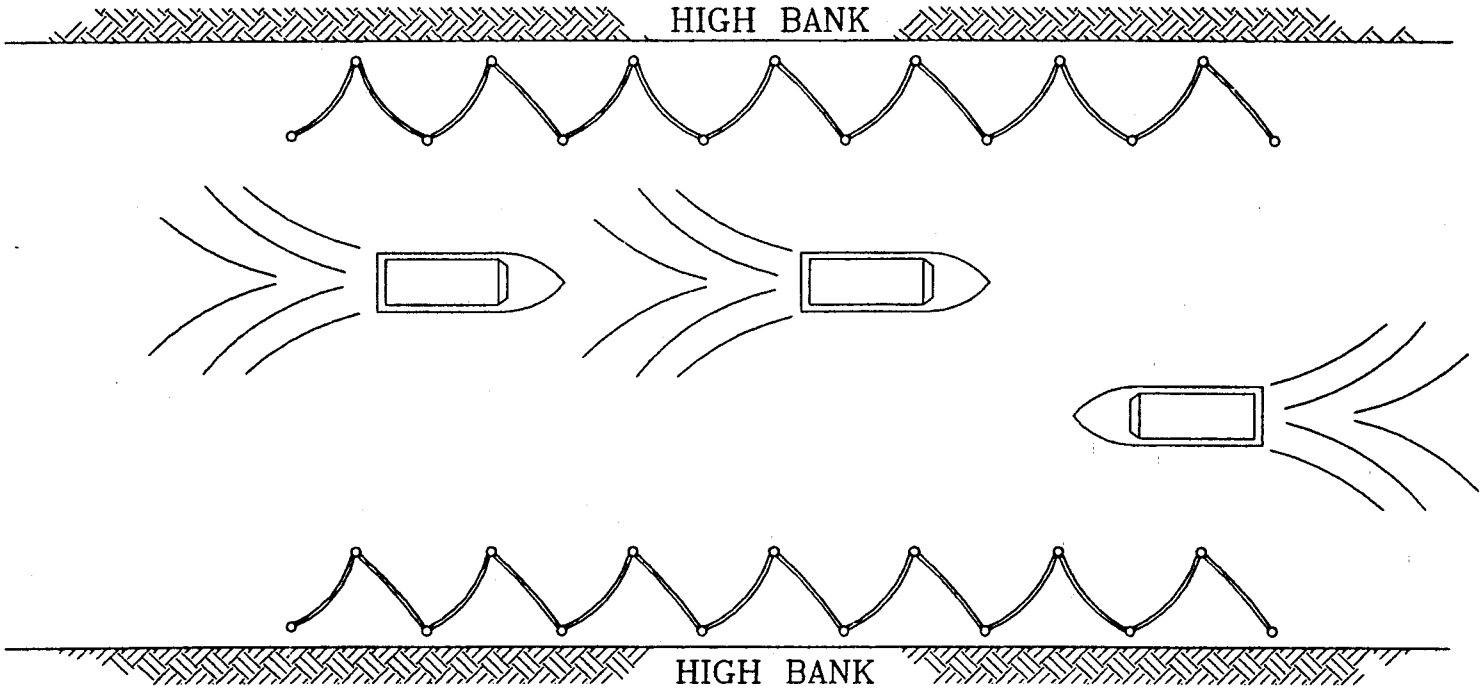
FIG. 18 illustrates the application of the present invention for bidirectional application.

FIG. 18 illustrates two high banks in a channel or intracoastal waterway. The control structures as practiced by the present invention can be woven in front of the high bank to provide for bidirectional capabilities. Similarly, it can be appreciated that any bank curvature can be adequately protected by use of the present invention.

Additional advantages and modifications will readily occur to those skilled in the art. The invention in its broader aspects is therefore not limited to the specific details, representative method and apparatus described herein. Accordingly, departures may be made from the detail without departing from the spirit or scope of the disclosed general inventive concept.

What is claimed is:

1. A method for ascertaining the permeability effective for preventing and repairing scour or erosion in a control zone associated with a river or shoreline having one or more bends, a bank, a bed, a bar, a bank gradient, a bar gradient, a height of the bank above the bed, a height of the bar above the bed, a reach, a cross-over line and a cross-over point on the bank associated with a moving fluid, the method comprising the steps of:

(a) measuring the reach upstream of the control zone;

(b) evaluating the direction of the moving fluid in the bed;

(c) establishing the cross-over line associated with the measured reach and the direction of the moving fluid;

(d) ascertaining the cross-over point on the bank based upon the established cross-over line;

(e) locating the control zone for receiving the cross-over point at the center of the control zone;

(f) determining bank characteristics upstream of, within and downstream of the control zone;

(g) determining bed characteristics upstream of, within and downstream of the control zone;

(h) determining fluid characteristics upstream of, within and downstream of the control zone; and (i) employing the determined characteristics for ascertaining an effective permeability for preventing and repairing scour or erosion in the control zone associated with the river or shoreline such that the effective permeability is operably at the center of the control zone and in contact with the cross-over point, and further such that the permeability is decreasing at locations upstream of the center of the control zone and the permeability is decreasing at locations downstream of the center of the control zone thereby providing the effective permeability at the center of the control zone.

2. A method as defined in claim 1 wherein the step of determining bank characteristics upstream of, within and downstream of the control zone compries the steps of:

(a) determining at least one spatial property of the bank; and (b) determining at least one physical parameter of the bank.

3. A method as defined in claim 1 wherein the step of determining bed characteristics upstream of, within and downstream of the control zone comprises the steps of:

(a) determining at least one spatial property of the bed; and (b) determining at least one physical parameter of the bed.

4. A method as defined in claim 1 wherein the step of determining fluid characteristics upstream of, within and downstream of the control zone comprises the steps of:

(a) determining at least one spatial property of the fluid in the bed; and (b) determining at least one physical parameter of the fluid in the bed.

5. A method for ascertaining the permeability effective for preventing and repairing scour or erosion in a control zone associated with a river or shoreline having a bank and a bed associated with a moving fluid, the method comprising the steps of:

(a) determining at least one spatial property of the bank;

(b) determining at least one physical parameter of the bank;

(c) determining at least one spatial property of the bed;

(d) determining at least one physical parameter of the bed;

(e) determining at least one spatial property of the fluid in the bed;

(f) determining at least one physical parameter of the fluid in the bed; and (g) employing the spatial property determinations and the physical parameter determinations for ascertaining a permeability effective for preventing and repairing scour or erosion in a control zone associated with the river or shoreline.

6. A method as defined in claim 5 wherein the step of determining at least one spatial property of the bank comprises the step of assessing the height of the bank contiguous with the control zone.

7. A method as defined in claim 5 wherein the step of determining at least one spatial property of the bank comprises the step of assessing the relative height of the bank opposite the control zone.

8. A method as defined in claim 5 wherein the step of determining at least one spatial property of the bank comprises the step of assessing a change in the height of the bank.

9. A method as defined in claim 5 wherein the step of determining at least one physical parameter of the bank comprises the step of assessing the density of the bank.

10. A method as defined in claim 5 wherein the step of determining at least one physical parameter of the bank comprises the step of assessing the rigidity of the bank.

11. A method as defined in claim 5 wherein the step of determining at least one physical parameter of the bank comprises the step of assessing the porosity of the bank.

12. A method as defined in claim 5 wherein the step of determining at least one spatial property of the bed comprises the step of assessing the gradient of the bed.

13. A method as defined in claim 12 wherein the step of assessing the gradient of the bed comprises the step of determining the incline of the bed between adjacent bank locations.

14. A method as defined in claim 5 wherein the step of determining at least one spatial property of the bed comprises the step of assessing the reach of the river upstream of the control zone.

15. A method as defined in claim 5 wherein the step of determining at least one physical parameter of the bed comprises the step of assessing the density of the bed.

16. A method as defined in claim 5 wherein the step of determining at least one physical parameter of the bed comprises the step of assessing the porosity of the bed.

17. A method as defined in claim 5 wherein the step of determining at least one physical parameter of the bed comprises the step of assessing the sediment in suspension of the fluid associated with the bed.

18. A method as defined in claim 5 wherein the step of determining at least one physical parameter of the bed comprises the step of assessing the fluidity of the bed.

19. A method as defined in claim 5 wherein the step of determining at least one spatial property of the fluid in the bed comprises the step of assessing the present crossover point of impact of the fluid with respect to the control zone.

20. A method as defined in claim 5 wherein the step of determining at least one spatial property of the fluid in the bed comprises the step of assessing the possible movement of the crossover point of impact of the fluid with respect to the control zone.

21. A method as defined in claim 5 wherein the step of determining at least one spatial property of the fluid in the bed comprises the step of assessing the direction of the fluid in the river.

22. A method as defined in claim 5 wherein the step of determining at least one physical parameter of the fluid in the bed comprises the step of assessing the sediment load of the fluid in the river.

23. A method as defined in claim 5 wherein the step of determining at least one physical parameter of the fluid in the bed comprises the step of assessing sediment drop out velocities of the fluid in the bed.

24. A method as defined in claim 5 wherein the step of determining at least one physical parameter of the fluid in the bed comprises the step of assessing the speed of the fluid in the river.

25. A method as defined in claim 24 wherein the step of assessing the speed of the fluid in the bed comprises the step of determining the velocity of the moving fluid at the minimum flow of the river.

26. A method as defined in claim 24 wherein the step of assessing the speed of the fluid in the bed comprises the step of determining the velocity of the moving fluid at the maximum flow of the river.

27. A method as defined in claim 24 wherein the step of assessing the speed of the fluid in the bed comprises the step of determining the velocity of the moving fluid at the minimum flow of the river and at the maximum flow of the river.

28. A method as defined in claim 5 wherein the step of determining at least one physical parameter of the fluid in the bed comprises the step of assessing the sediment in suspension of the fluid in the river.

29. A method as defined in claim 5 wherein the step of determining at least one physical parameter of the fluid in the bed comprises the step of assessing the temperature of the fluid in the river.

30. A method as defined in claim 5 wherein the step of determining at least one physical parameter of the fluid in the bed comprises the step of assessing the density of the fluid in the river.

31. A method as defined in claim 5 wherein the step of determining at least one physical parameter of the fluid in the bed comprises the step of assessing the salinity of the fluid in the river.

32. A method as defined in claim 5 wherein the step of determining at least one physical parameter of the fluid in the bed comprises the step of assessing the surface tension of the fluid in the river.

33. A method as defined in claim 5 wherein the step of determining at least one physical parameter of the fluid in the bed comprises the step of assessing the pressure of the fluid in the river.

34. A method as defined in claim 5 further comprising the step of permeating the moving fluid prior to contacting the bank in the control zone.

35. A method as defined in claim 5 wherein the moving fluid is a mixture of sediment and water.

36. A method for ascertaining the permeability effective for preventing and repairing scour or erosion in a control zone associated with a river or shoreline having a bank and a bed associated with a moving fluid, the method comprising the steps of:

(a) determining at least one spatial property of the bank comprising the steps of:
  (1) assessing the height of the bank contiguous with the control zone; and
  (2) assessing the relative height of the bank opposite the control zone;
(b) determining at least one physical parameter of the bank;
(c) determining at least one spatial property of the bed comprising the steps of:
  (1) assessing the gradient of the bed;
  (2) assessing the reach of the bed of the river upstream of the control zone;
(d) determining at least one physical parameter of the bed;
(e) determining at least one spatial property of the fluid in the bed comprising the steps of:
  (1) assessing the present crossover point of impact of the fluid with respect to the control zone; and
  (2) assessing the possible movement of the crossover point of impact of the fluid with respect to the control zone;
(f) determining at least one physical parameter of the fluid in the bed comprising the steps of:
  (2) assessing the speed of the fluid in the bed at the minimum flow of the river and at the maximum flow of the river;
  (2) assessing the drop out velocities of the fluid in the bed;
  (3) assessing the sediment load of the fluid in the bed; and
(g) employing the spatial property determinations and the physical parameter determinations for ascertaining a permeability effective for preventing and repairing scour or erosion in control zone associated with the river or shoreline.

37. A method of preventing and repairing scour or erosion in a control zone associted with a river or shoreline having a bank and a bed associated with a moving fluid, the method comprising the steps of:

(a) determining at least one spatial property of the bank;
(b) determining at least one physical parameter of the bank;
(c) determining at least one spatial property of the bed;
(d) determining at least one physical parameter of the bed;
(e) determining at least one spatial property of the fluid in the bed;
(f) determining at least one physical parameter of the fluid in the bed;
(g) employing the spatial property determinations and the physical parameter determinations for eliciting one or more permeability effective for preventing and repairing scour or erosion in control zone associated with the river or shoreline; and
(h) permeating the moving fluid with the elicited permeability prior to the moving fluid contacting the bank in the control zone.

38. A method for preventing and repairing scour or erosion in a control zone associated with a river or shoreline having a bank and a bed associated with a moving fluid, the method comprising the steps of:

(a) determining at least one spatial property of the bank comprising the steps of:
(1) assessing the height of the bank contiguous with the control zone; and
(2) assessing the relative height of the bank opposite the control zone;
(b) determining at least one physical parameter of the bank;
(c) determining at least one spatial property of the bed comprising the steps of:
  (1) assessing the gradient of the bed;
  (2) assessing the reach of the bed of the river upstream of the control zone;
(d) determining at least one physical parameter of the bed;
(e) determining at least one spatial property of the fluid in the bed comprising the steps of:
  (1) assessing the present crossover point of impact of the fluid with respect to the control zone; and
  (2) assessing the possible movement of the crossover point of impact of the fluid with respect to the control zone;
(f) determining at least one physical parameter of the fluid in the bed comprising the steps of:
  (1) assessing the speed of the fluid in the bed at the minimum flow of the river and at the maximum flow of the river;
  (2) assessing the drop out velocities of the fluid in the bed;
  (3) assessing the sediment load of the fluid in the bed;
(g) employing the spatial property determinations and the physical parameter determinations for eliciting one or more permeability effective for preventing and repairing scour or erosion in control zone associated with the river or shoreline; and
(h) permeating the moving fluid with the elicited permeability prior to the moving fluid contacting the bank in the control zone.

* * * * *